US008744841B2

(12) United States Patent
Oh et al.

(10) Patent No.: US 8,744,841 B2
(45) Date of Patent: Jun. 3, 2014

(54) ADAPTIVE TIME AND/OR FREQUENCY-BASED ENCODING MODE DETERMINATION APPARATUS AND METHOD OF DETERMINING ENCODING MODE OF THE APPARATUS

(75) Inventors: Eun Mi Oh, Seoul (KR); Ki Hyun Choo, Seoul (KR); Jung-Hoe Kim, Seoul (KR); Chang Yong Son, Gunpo-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 1275 days.

(21) Appl. No.: 11/524,274

(22) Filed: Sep. 21, 2006

(65) Prior Publication Data

US 2007/0174051 A1 Jul. 26, 2007

(30) Foreign Application Priority Data

Jan. 24, 2006 (KR) ..... 10-2006-0007341

(51) Int. Cl.
*G10L 19/00* (2006.01)

(52) U.S. Cl.
USPC ..... 704/201; 704/203; 704/205; 704/267; 704/269; 704/500

(58) Field of Classification Search
None
See application file for complete search history.

(56) References Cited

U.S. PATENT DOCUMENTS

| | | | | |
|---|---|---|---|---|
| 6,134,518 | A | 10/2000 | Cohen et al. | |
| 6,449,590 | B1 * | 9/2002 | Gao | 704/219 |
| 6,718,036 | B1 * | 4/2004 | Van Schyndel et al. | 379/406.03 |
| 6,785,645 | B2 * | 8/2004 | Khalil et al. | 704/216 |
| 2002/0035407 | A1 * | 3/2002 | Ishito et al. | 700/94 |
| 2003/0009325 | A1 | 1/2003 | Kirchherr et al. | |
| 2003/0088400 | A1 * | 5/2003 | Nishio et al. | 704/201 |
| 2003/0088423 | A1 * | 5/2003 | Nishio et al. | 704/500 |
| 2003/0195742 | A1 * | 10/2003 | Tsushima et al. | 704/205 |
| 2004/0030546 | A1 * | 2/2004 | Sato | 704/207 |

OTHER PUBLICATIONS

Korean International Search Report dated Mar. 7, 2007 issued in PCT/KR2006/005218.

Griffin, D.W.; Lim, J. S. Multiband Excitation Vocoder. IEEE Transactions on Acoustics, Speech, and Signal Processing. Aug. 1988, vol. 36, No. 8, pp. 1223-1235.

* cited by examiner

*Primary Examiner* — Leonard Saint Cyr
(74) *Attorney, Agent, or Firm* — Stanzione & Kim, LLP

(57) ABSTRACT

An adaptive time/frequency-based encoding mode determination apparatus including a time domain feature extraction unit to generate a time domain feature by analysis of a time domain signal of an input audio signal, a frequency domain feature extraction unit to generate a frequency domain feature corresponding to each frequency band generated by division of a frequency domain corresponding to a frame of the input audio signal into a plurality of frequency domains, by analysis of a frequency domain signal of the input audio signal, and a mode determination unit to determine any one of a time-based encoding mode and a frequency-based encoding mode, with respect to the each frequency band, by use of the time domain feature and the frequency domain feature.

19 Claims, 7 Drawing Sheets

ADAPTIVE TIME AND/OR FREQUENCY-BASED ENCODING MODE DETERMINATION APPARATUS AND METHOD OF DETERMINING ENCODING MODE OF THE APPARATUS

CROSS-REFERENCE TO RELATED APPLICATIONS

This application claims priority under 35 U.S.C §119(a) from Korean Patent Application No. 10-2006-0007341, filed on Jan. 24, 2006, in the Korean Intellectual Property Office, the disclosure of which is incorporated herein in its entirety by reference.

BACKGROUND OF THE INVENTION

1. Field of the Invention

The present general inventive concept relates to an audio encoding and/or decoding apparatus and method, and particularly, to an adaptive time/frequency-based audio encoding apparatus and a method of determining an encoding mode of the apparatus, in which time-based encoding or frequency-based encoding is adaptively applied according to a data property, thereby acquiring high compression efficiency with the use of a coding advantage of the time-based and frequency-based encoding modes.

2. Description of the Related Art

Conventional voice/audio compression modes are largely classified into two types. One type is audio codec and the other type is voice codec. The audio codec, such as aacPlus, is an algorithm to compress a signal in a frequency domain, to which a psychoacoustic model is applied. When the audio codec is used to compress a voice signal instead of an audio signal, timbre is deteriorated much more than if the voice signal was compressed with the voice codec mode, even if a same amount of data is encoded. Particularly, there is greater timbre deterioration around a frequency of an attack signal. On the other hand, the voice codec such as AMR-WB is an algorithm to compress a signal in a time domain. When the voice codec is used to compress an audio signal instead of a voice signal, timbre is deteriorated much more than if the audio signal was compressed with audio codec mode, even if a same amount of data is encoded.

Considering the aforementioned conventional problems with the voice/audio compression modes, there has been provided an Adaptive Multi-Rate Wideband codec (AMR-WB)+ mode (3GPP TS 26,290) as a conventional technology to efficiently perform voice/audio compression simultaneously. In the AMR-WB+mode (3GPP TS 26,290), Algebraic Code Excited Linear Prediction (ACELP) is used to compress a voice, and Transform Coded Excitation (TCX) is used to compress an audio. The AMR-WB+ mode (3GPP TS 26,290) determines whether to apply the ACELP mode or the TCX mode to encode, for each frame. Particularly, the AMR-WB+ mode (3GPP TS 26,290) operates efficiently when compressing an object similar to a voice signal. However, deterioration of timbre or a compression ratio, caused by an encoding process for each frame, occurs when the object to be compressed is similar to an audio signal.

Accordingly, when input audio data is encoded by selectively applying an encoding mode, an encoding mode determination as well as standards associated with the encoding mode determination are very important factors which have a great effect on encoding performance.

SUMMARY OF THE INVENTION

An aspect of the present general inventive concept provides a method and apparatus, in which an encoding mode with respect to an input audio signal is determined for each frequency band to time-based encode or frequency-based encode each frequency band of the input audio signal, thereby acquiring high-compression performance by efficiently using a coding gain of both the time-based and the frequency-based encoding modes.

An aspect of the present general inventive concept also provides a method and apparatus, in which a long-term feature and a short-term feature are extracted for each time domain and frequency domain to determine a suitable encoding mode for each frequency band, to thereby optimize adaptive time and/or frequency-based audio encoding performance.

An aspect of the present general inventive concept also provides a method and apparatus in which an open loop determination style is used, thereby having low complexity to effectively determine an encoding mode.

Additional aspects and advantages of the present general inventive concept will be set forth in part in the description which follows and, in part, will be obvious from the description, or may be learned by practice of the general inventive concept.

The foregoing and/or other aspects and utilities of the present general inventive concept may be achieved by providing an adaptive time and/or frequency-based encoding mode determination apparatus including a time domain feature extraction unit to generate a time domain feature by analyzing a time domain signal of an input audio signal, a frequency domain feature extraction unit to generate a frequency domain feature corresponding to each frequency band generated by dividing a frequency domain corresponding to a frame of the input audio signal into a plurality of frequency domains, by analyzing a frequency domain signal of the input audio signal, and a mode determination unit to determine one of a time-based encoding mode and a frequency-based encoding mode with respect to the each frequency band, with use of the time domain feature and the frequency domain feature.

The foregoing and/or other aspects and utilities of the present general inventive concept may also be achieved by providing an adaptive time and/or frequency-based audio encoding apparatus including, a time domain feature extraction unit to generate a time domain feature by analyzing a time domain signal of an input audio signal, a frequency domain feature extraction unit to generate a frequency domain feature corresponding to each frequency band generated by dividing a frequency domain corresponding to a frame of the input audio signal into a plurality of frequency domains, by analyzing a frequency domain signal of the input audio signal, a mode determination unit to determine one of a time-based encoding mode and a frequency-based encoding mode with respect to the each frequency band, with the use of the time domain feature and the frequency domain feature, an encoding unit to encode with the determined encoding mode with respect to the each frequency band to generate encoded data, and a bit stream output unit to process a bit stream with respect to the encoded data and to output the processed bit stream.

When the frequency domain feature extraction unit analyzes a frequency domain signal of a current frame of the input audio signal, the time domain feature extraction unit analyzes a time domain signal corresponding to a frequency domain signal of either the current frame or a next frame of the input audio signal.

The time domain feature may be a time domain short-term feature of the input audio signal and the frequency domain feature may be a frequency domain short-term feature corresponding to the each frequency band. The apparatus further includes a long-term feature extraction unit to generate a time domain long-term feature and a frequency domain long-term feature by analyzing the time domain short-term feature and the frequency domain short-term feature. The mode determination unit determines the encoding mode by further with use of the time domain long-term feature and the frequency domain long-term feature.

The foregoing and/or other aspects and utilities of the present general inventive concept may also be achieved by providing an adaptive time and/or frequency-based encoding mode determination method, the method including, generating a time domain feature by analyzing a time domain signal of an input audio signal, generating a frequency domain feature corresponding to each frequency band generated by dividing a frequency domain corresponding to a frame of the input audio signal into a plurality of frequency domains, by analyzing a frequency domain signal of the input audio signal, and determining one of a time-based encoding mode and a frequency-based encoding mode with respect to the each frequency band, by using the time domain feature and the frequency domain feature.

The foregoing and/or other aspects and utilities of the present general inventive concept may also be achieved by providing a computer readable recording medium in which a program to execute an adaptive time and/or frequency-based encoding mode determination method is recorded, the method including generating a time domain feature by analysis of a time domain signal of an input audio signal, generating a frequency domain feature corresponding to each frequency band generated by division of a frequency domain corresponding to a frame of the input audio signal into a plurality of frequency domains, by analysis of a frequency domain signal of the input audio signal, and determining any one of a time-based encoding mode and a frequency-based encoding mode, with respect to the each frequency band, by use of the time domain feature and the frequency domain feature.

The foregoing and/or other aspects and utilities of the present general inventive concept may also be achieved by providing an adaptive time and/or frequency-based encoding apparatus including a mode determination unit to determine a time-based encoding mode and a frequency-based encoding mode as an encoding mode according to a frequency domain feature and a time domain feature with respect to respective frequency bands of a frame of an audio signal, and an encoder to encode respective frequency bands according to corresponding ones of the time-based encoding mode and the frequency-based encoding mode.

The foregoing and/or other aspects and utilities of the present general inventive concept may also be achieved by providing an adaptive time and/or frequency-based encoding device including a domain feature extraction unit to extract a time domain feature and a frequency domain feature with respect to a first frequency band and a second frequency band of an input audio signal, respectively, a mode determination unit to determine a time-based encoding mode and a frequency-based encoding mode according to the time domain feature and the frequency domain feature, and an encoder to encode the first frequency band according to the time-based encoding mode and the second frequency band according to the frequency-based encoding mode.

The foregoing and/or other aspects and utilities of the present general inventive concept may also be achieved by providing an encoding and/or decoding system including a mode determination unit to determine a time-based encoding mode and a frequency-based encoding mode as an encoding mode according to a frequency domain feature and a time domain feature with respect to respective frequency bands of a frame of an audio signal, and an encoder to encode respective frequency bands according to corresponding ones of the time-based encoding mode and the frequency-based encoding mode and to generate a bit stream, and a decoder to receive the bit stream and to decode the respective frequency bands according to corresponding ones of a time decoding mode corresponding to the time encoding mode and a frequency decoding mode corresponding to the frequency encoding mode.

The foregoing and/or other aspects and utilities of the present general inventive concept may also be achieved by providing an adaptive time and/or frequency-based decoding device including a bit stream input unit to receive a processed bit stream, the processed bit stream including time-based encoded data, frequency-based encoded data, information associated with a division of a frequency spectrum of a frequency domain signal into individual frequency bands, and encoding mode information corresponding to a mode determination of the individual frequency bands, and a decoding unit to decode the time-based encoded data and the frequency-based encoded data with respect to the individual frequency bands to generate decoded data representing an output audio signal.

The time-based encoding mode may indicate a voice compression algorithm to compress a signal on a time axis, such as Code Excited Linear Prediction (CELP), and the frequency-based encoding mode may indicate an audio compression algorithm to compress a signal on a frequency axis, such as Transform Coded Excitation (TCX) and Advanced Audio Codec (AAC).

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
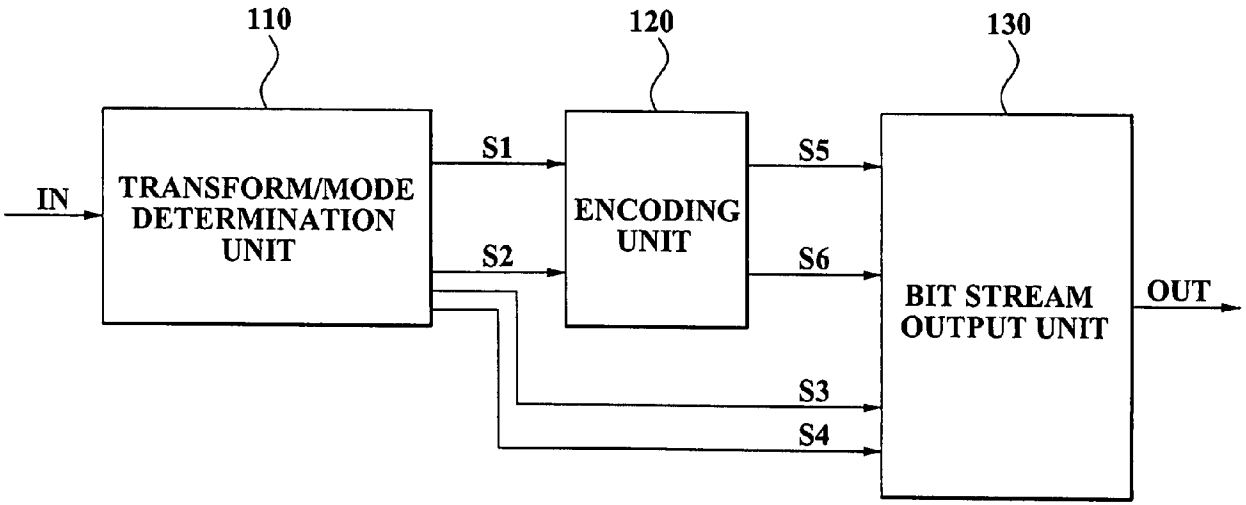
FIG. 1 is a block diagram illustrating an adaptive time and/or frequency-based audio encoding apparatus of an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a block diagram illustrating an adaptive time and/or frequency-based audio encoding apparatus according to an embodiment of the present general inventive concept.

Referring to FIG. 1, the adaptive time/frequency-based audio encoding apparatus includes a transform/mode determination unit 110, an encoding unit 120, and a bit stream output unit 130.

The transform/mode determination unit 110 frequency-transforms an input audio signal IN for each frame and determines whether a time-based encoding mode or a frequency-based encoding mode is to be utilized, with respect to each frequency band generated, by dividing a transformed frequency domain into a plurality of frequency domains. In this process, the transform/mode determination unit 110 outputs a frequency domain signal S1 determined to be the time-based encoding mode, a frequency domain signal S2 determined to be the frequency-based encoding mode, information S3 with respect to frequency domain division, and encoding mode information S4 of the each frequency band. In this case, when the frequency domain is equally divided, since the division information may not be required for decoding, the information S3 with respect to the frequency domain division may not be used.

The encoding unit 120 time-based encodes the frequency domain signal S1 determined to be the time-based encoding mode, frequency-based encodes the frequency domain signal S2 determined to be the frequency-based encoding mode, and outputs time-based encoded data S5 and frequency-based encoded data S6.

The bit stream output unit 130 processes a bit stream with respect to the encoded data S5 and S6 and outputs the processed bit stream OUT. In this case, the bit stream output unit 130 may process the bit stream by using the information S3 with respect to the frequency domain division and the encoding mode information S4 of the each frequency band. In this case, the bit stream may go through a data compression process such as entropy encoding.

Figure 2:
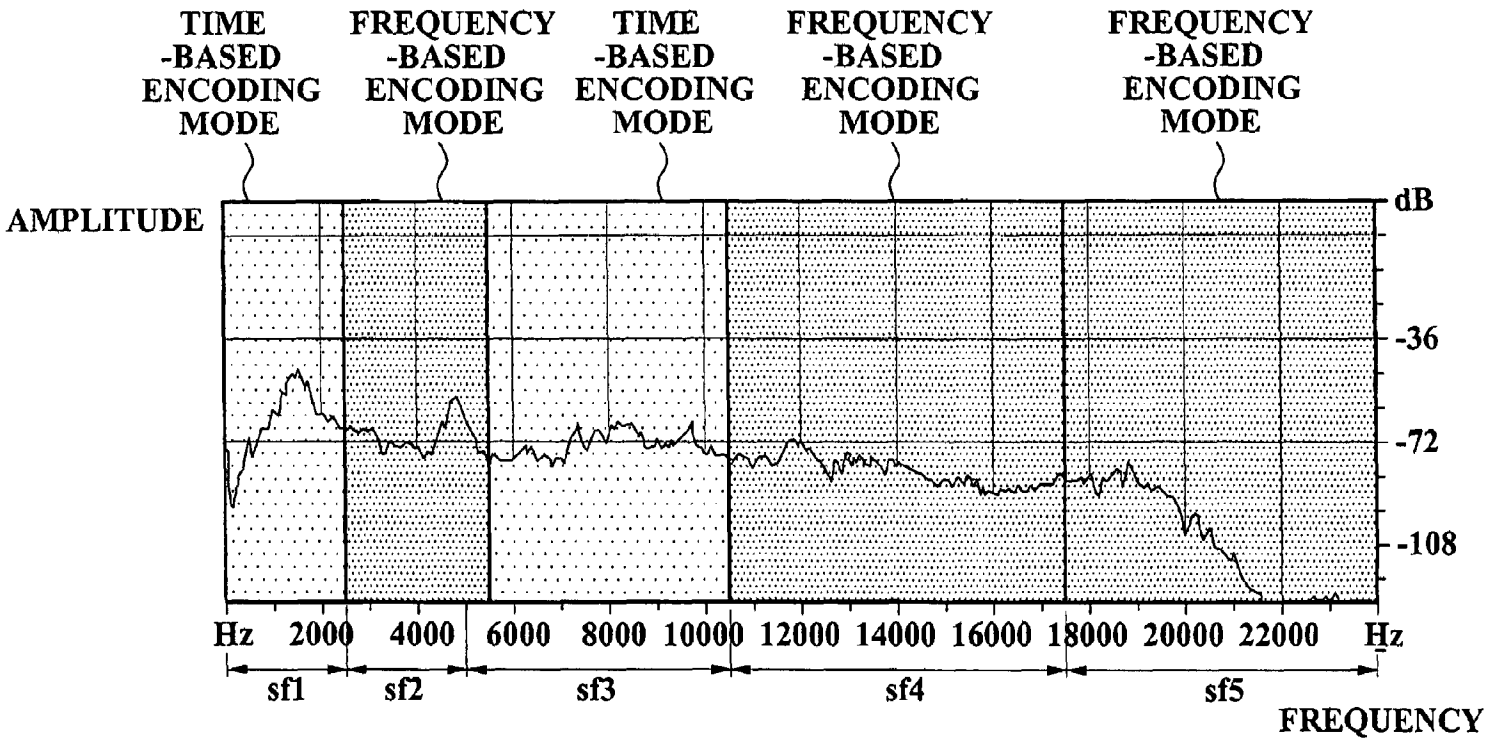
FIG. 2 is a diagram illustrating a process to divide a signal transformed in a frequency domain and to determine an encoding mode.

FIG. 2 is a diagram illustrating a process to divide a signal transformed in a frequency domain and to determine an encoding mode.

Referring to FIG. 2, an input audio signal includes a frequency component of 22,000 Hz and has a bandwidth that may be divided into 5 frequency bands. Encode modes corresponding to the divided frequency bands in the audio signal are determined to be a time-based encoding mode, a frequency-based encoding mode, the time-based encoding mode, the frequency-based encoding mode, and the frequency-based encoding mode, in an order of a low frequency to a high frequency. In this case, the input audio signal is an audio frame of a predetermined time period, for example, approximately 20 ms. In FIG. 2, the audio frame is frequency-transformed for a predetermined time. As shown in FIG. 2, the audio frame is divided into five frequency bands sf1, sf2, sf3, sf4, and sf5.

As illustrated in FIG. 2, the frequency bands sf1, sf2, sf3, sf4, and sf5 are made by dividing a frequency domain where each of the frequency bands corresponds to one frame in a time domain. An allocation of a suitable encoding mode with respect to each of the divided frequency bands sf1, sf2, sf3, sf4, and sf5 is very important. In this case, a suitable encoding mode determination may be performed by using a time domain feature and a frequency domain feature of the input audio signal for each frequency band. The encoding mode determination of each frequency band will be described later.

Figure 3:
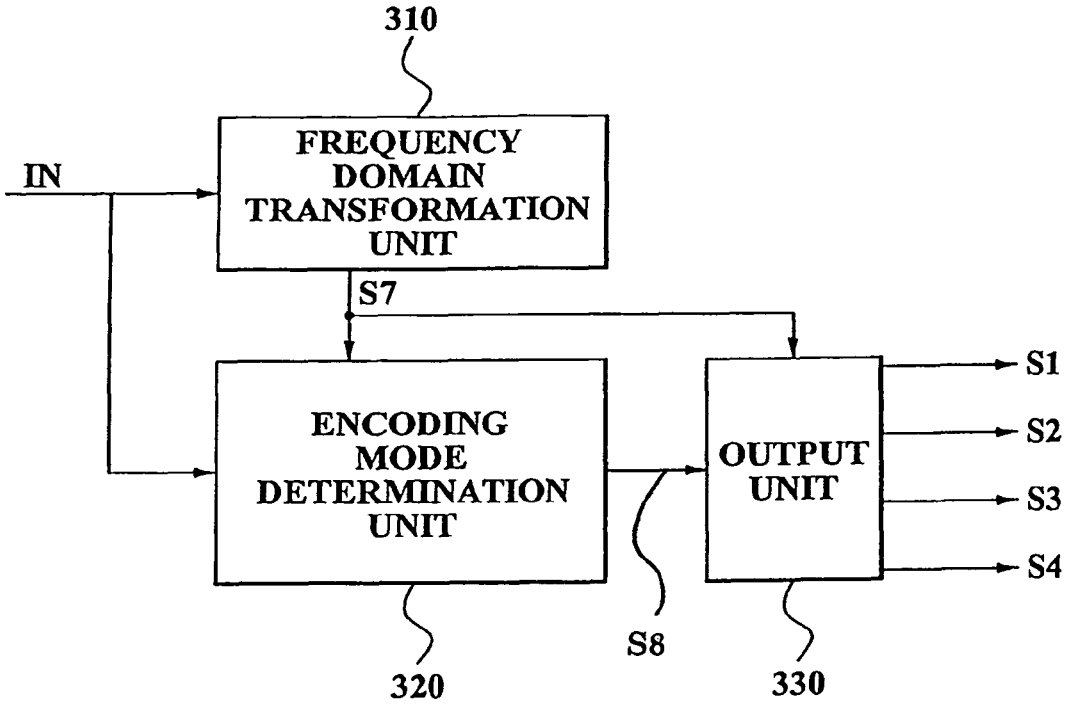
FIG. 3 is a block diagram illustrating a transform/mode determination unit of in FIG. 1.

FIG. 3 is a block diagram illustrating an example of the transform/mode determination unit 110 illustrated in FIG. 1. Referring to FIG. 3, the transform/mode determination unit 110 includes a frequency domain transformation unit 310, an encoding mode determination unit 320, and an output unit 330.

The frequency domain transformation unit 310 transforms the input audio signal IN into a frequency domain signal S7 such as a frequency spectrum illustrated in FIG. 2. For example, the frequency domain transformation unit 310 may perform modulated lapped transform (MLT) with respect to the input audio signal IN. Modulated lapped transforms may be either a time-varying MLT type or a frequency varying MLT type.

Particularly, the frequency domain transformation unit 310 may perform frequency varying MLT with respect to the input audio signal IN. The frequency varying MLT was introduced by M. Purat and P. Noll in "A New Orthonormal Wavelet Packet Decomposition for Audio Coding Using Frequency-Varying Modulated Lapped Transform", IEEE Workshop on Application of Signal Processing to Audio and Acoustics, October 1995.

When using the frequency varying MLT, frequency-based encoding may be performed with respect to some frequency bands of a frequency domain signal transformed in frequency, an inverse MLT may be performed to transform some frequency bands into a time domain signal, and time-based encoding may be performed with respect to other frequency bands. When the frequency varying MLT is performed with respect to a frequency band to generate the time-based encoded signal of the frequency band which is added to the frequency-based encoded frequency signal of the frequency band, a signal having the time-based encoded signal and the frequency-based encoded signal throughout a whole frequency band is acquired.

The encoding mode determination unit 320 analyzes the input audio signal IN that is a time domain signal, and a frequency domain signal S7 that is generated by transforming a frequency of the input audio signal IN, and determines one of a time-based encoding mode and a frequency-based encoding mode for each frequency band. In this case, the encoding mode determination unit 320 may analyze a frequency domain signal of a current frame of the frequency domain signal S7 when analyzing a frequency domain signal of a current or next frame of the input audio signal IN that is the time domain signal.

A feature of the next frame is reflected when determining a mode of the current frame, thereby preventing a frequent switching of the frequency-based and the time-based modes for each frame to smoothly change the mode. For example, after an average value of a previous, current, and next feature values is used or a mode of a current frame is determined with use of the previous and current features, switching is delayed due to a feature value of the next frame and determination is carried forward to the next frame, thereby embodying the encoding mode determination unit 320.

The output unit 330 receives the frequency domain signal S7 and a mode signal S8 representing one of the frequency-based and the time-based modes and outputs the frequency domain signal determined to be the time-based encoding mode S1, the frequency domain signal determined to be the frequency-based encoding mode S2, the information associated with a frequency domain division S3, and the encoding mode information S4 according to a determination result of the encoding mode determination unit 320. The frequency domain division S3 represents a division of the frequency spectrum into frequency bands. As illustrated in FIG. 2, the frequency spectrum may be divided into frequency bands sf1, sf2, sf3, sf4, and sf5 by dividing a frequency domain where each of the frequency bands corresponds to one frame in a time domain.

Figure 4:
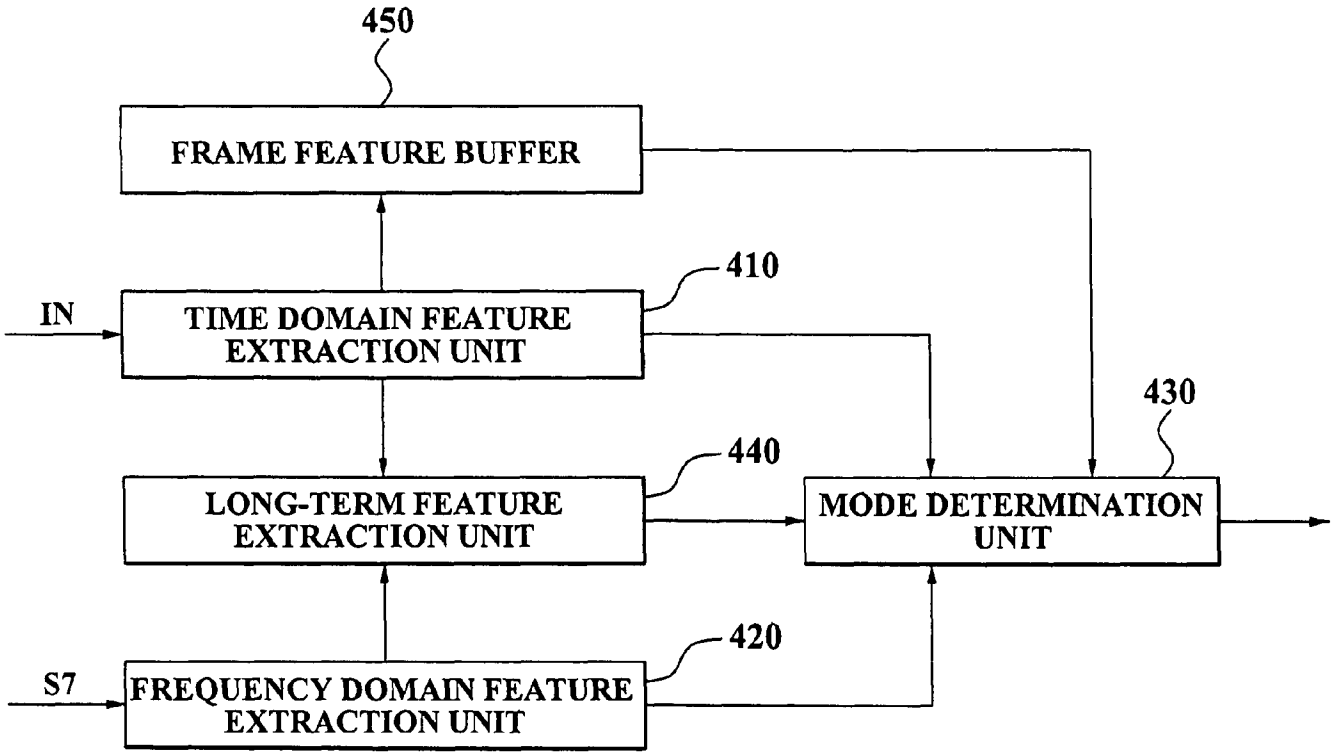
FIG. 4 is a block diagram illustrating an adaptive time and/or frequency-based encoding mode determination apparatus of an embodiment of the present general inventive concept.

FIG. 4 is a block diagram illustrating an adaptive time and/or frequency-based encoding mode determination apparatus according to an embodiment of the present general inventive concept.

Referring to FIG. 4, the adaptive time and/or frequency-based encoding mode determination apparatus includes a time domain feature extraction unit 410, a frequency domain feature extraction unit 420, a mode determination unit 430, a long-term feature extraction unit 440, and a frame feature buffer 450.

The adaptive time and/or frequency-based encoding mode determination apparatus may be used as the encoding mode determination unit 320 illustrated in FIG. 3.

The time domain feature extraction unit 410 generates a time domain feature by analyzing a time domain signal of an input audio signal IN. In this case, particularly, the time domain feature may be a time domain short-term feature. For example, the time domain short-term feature may include extent of a transition and a size of a short-term/long-term prediction gain.

The frequency domain feature extraction unit 420 generates a frequency domain feature corresponding to each frequency band generated by dividing a frequency domain corresponding to one frame of the input audio signal IN into a plurality of frequency domains, by analyzing a frequency domain signal of the input audio signal IN. In this case, the frequency domain feature extraction unit 420 may receive the frequency domain signal S7 of the input audio signal IN from the frequency domain transformation unit 310 illustrated in FIG. 3 and may analyze each frequency band of the frequency domain to generate a frequency domain feature. In this case, the frequency domain feature may be a frequency domain short-term feature. For example, the frequency domain short-term feature may include voicing probability.

In this case, when the frequency domain feature extraction unit 420 analyzes a frequency domain signal of a current frame of the input audio signal IN, the time domain feature extraction unit 410 may analyze a time domain signal corresponding to a frequency domain signal of a current or next frame of the input audio signal IN. In this case, the frequency domain feature extraction unit 420 may window a part of a previous frame together with the current frame.

The long-term feature extraction unit 440 generates a time domain long-term feature and a frequency domain long-term feature by analyzing the time domain short-term feature and the frequency domain short-term feature.

In this case, the time domain long-term feature may include continuity of periodicity, a frequency spectral tilt, and/or frame energy. In this case, the continuity of periodicity may be that a frame in which a change of a pitch lag is small and a pitch correlation is high is continuously maintained for more than a certain period. Also, the continuity of periodicity may be that a frame in which a first formant frequency is very low and pitch correlation is high is continuously maintained for more than a certain period. In this case, the frequency domain long-term feature may include correlation between channels.

The frame feature buffer 450 receives and stores the time domain short-term feature from the time domain feature extraction unit 410. Accordingly, when the time domain feature extraction unit 410 outputs the time domain short-term feature corresponding to the next frame, the frame feature buffer 450 may output the time domain short-term feature corresponding to the current frame so that the mode determination unit 430 can analyze the current and the next frames of the time domain short-term feature to determine an encoding mode.

The mode determination unit 430 determines an encoding mode for each frequency band to be the time-based encoding mode or the frequency-based encoding mode by using the time domain short-term feature, the frequency domain short-term feature, the time domain long-term feature, and the frequency domain long-term feature. In this case, the mode determination unit 430 may determine the encoding mode of each frequency band by using a result of the time domain signal of the previous, current, and next frames and a result of analyzing the frequency domain signal of the previous, current, and next frames.

On one hand, when the input audio signal IN is a signal whose prediction gain is great using linear prediction or the input audio signal is a highly pitched signal such as a voice signal, the time-based encoding mode is effective. On the other hand, the frequency-based encoding mode is effective when the input audio signal is a sinusoidal signal, an additional high frequency signal is included in the audio signal, or a masking effect between signals is great.

Table 1 illustrates an example of a feature of the input audio signal that is effectively frequency-based encoded.

TABLE 1

| | Time domain feature | Frequency domain feature |
|---|---|---|
| Short-term feature | Signal having a weak transition extent<br>Signal having low short-term/long-term gain | Signal of a multi-band having a low voicing probability |
| Long-term feature | Signal having high periodicity is continuously maintained for long-term<br>Signal having a gentle frequency spectral tilt and having a high frame energy | Signal having low correlation between channels |

Table 2 illustrates an example of a feature of the input audio signal that is effectively time-based encoded.

TABLE 2

| | Time domain feature | Frequency domain feature |
|---|---|---|
| Short-term feature | Signal having a strong transition extent<br>Signal having a high short-term/long-term prediction gain | Signal of a multi-band having a high voicing probability |
| Long-term feature | Signal having a steep frequency spectral tilt with a continuous frame and having a small number of spectrum changes of a linear prediction filter | Signal having high correlation between channels |

For example, the mode determination unit 430 determines the encoding mode to be the frequency-based encoding mode when conditions similar to Table 1 exist and determines the encoding mode to be the time-based encoding mode when conditions similar to Table 2 exist, by using the time domain short-term feature, the frequency domain short-term feature, the time domain long-term feature, and the frequency domain long-term feature.

Figure 5:
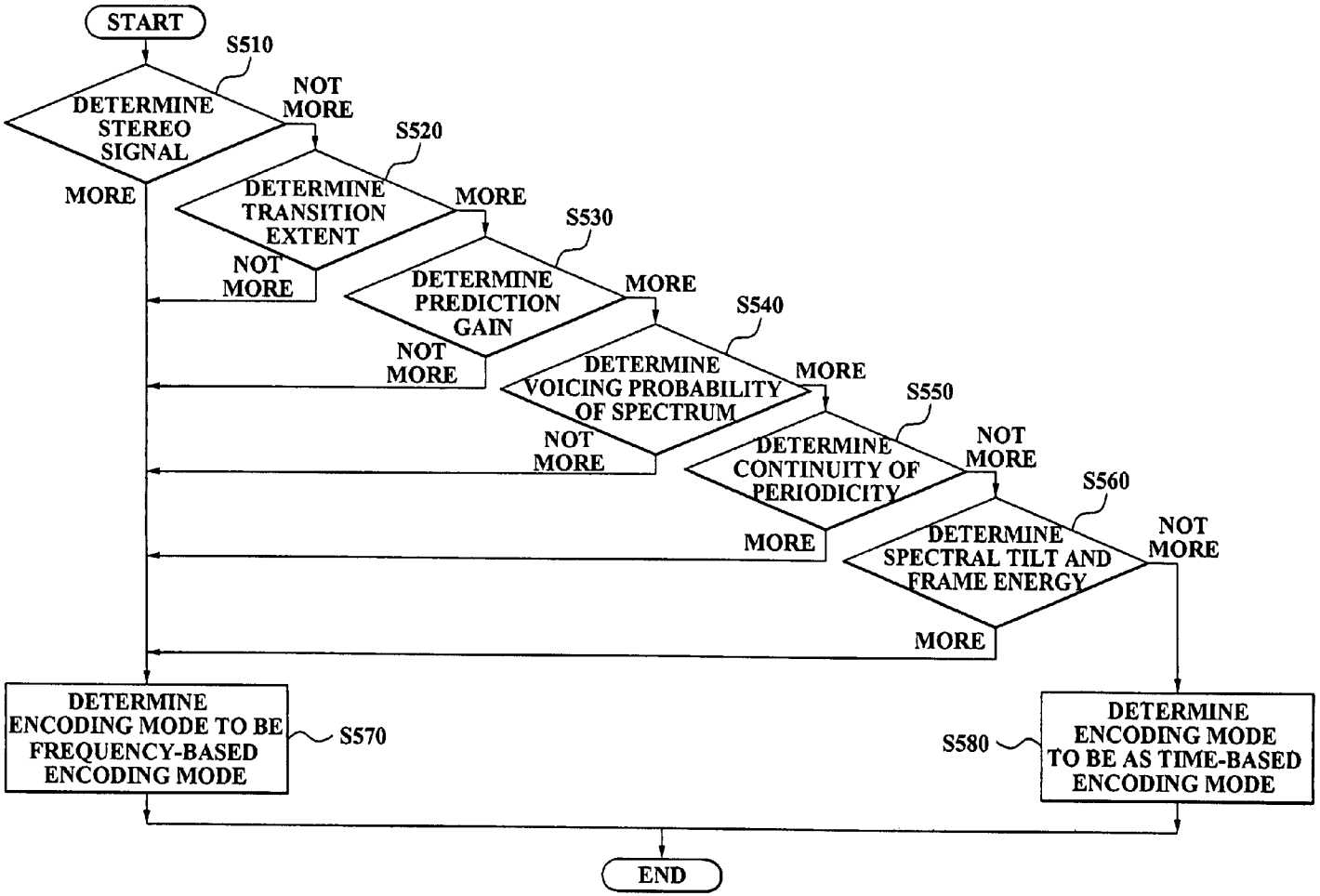
FIG. 5 is a flowchart illustrating operations of a mode determination unit of the adaptive time and/or frequency-based encoding mode determination apparatus of FIG. 4.

FIG. 5 is a flowchart illustrating operations of the mode determination unit 430 illustrated in FIG. 4.

Referring to FIGS. 4 and 5, the mode determination unit 430 determines whether a stereo signal of an input audio signal is higher than a predetermined level (operation S510).

As a determination result of operation S510, when the stereo signal is more than the predetermined level because correlation between channels, for example, left and right channels, of the input audio signal is low, the mode determination unit determines an encoding mode to be a frequency-based encoding mode (operation S570).

As the determination result of operation S510, when the stereo signal has a level not higher than the predetermined level because the correlation between the channels of the input audio signal is high, the mode determination unit 430 determines whether a transition extent of the input audio signal is more than a predetermined level (operation S520).

As a determination result of operation S520, when the transition extent of the input audio signal is not more than a predetermined level, the mode determination unit 430 determines the encoding mode to be the frequency-based encoding mode (operation S570).

As the determination result of operation S520, when the transition extent of the input audio signal is more than the predetermined level, the mode determination unit 430 determines whether a short-term/long-term prediction gain is more than a predetermined level (operation S530).

As a determination result of operation S530, when the short-term/long-term prediction gain of the input audio signal is not more than the predetermined level, the mode determination unit 430 determines the encoding mode to be the frequency-based encoding mode (operation S570).

As the determination result of operation S530, when the short-term/long-term prediction gain of the input audio signal is more than the predetermined level, the mode determination unit 430 determines whether a voicing probability corresponding to a relevant frequency band is more than a predetermined level (operation S540).

As a determination result of operation S540, when the voicing probability corresponding to the relevant frequency band is not more than the predetermined level, the mode determination unit determines the encoding mode to be the frequency-based encoding mode (operation S570).

As the determination result of operation S540, when the voicing probability corresponding to the relevant frequency band is more than the predetermined level, the mode determination unit determines whether continuity of periodicity of the input audio signal is continuously maintained for more than a predetermined term (operation S550). In this case, in operation S550, whether a frame in which a change of a pitch lag is small and a pitch correlation is high is continuously maintained for more than a certain period or a frame in which a first formant frequency is very low and pitch correlation is high is continuously maintained for more than the certain period may be determined.

As a determination result of operation S550, when the continuity of the periodicity of the input audio signal is continuously maintained for more than the predetermined period, the mode determination unit 430 determines the encoding mode to be the frequency-based encoding mode (operation S570).

As described above, the short-term features in the time domain may include the extent of a transition and/or size of a prediction gain (e.g., using linear prediction). The short-term features in the frequency domain may include voicing probability. The long-term features in the time domain may include continuity of periodicity, frequency spectral tilt, and/or frame energy. The long-term features in the frequency domain may include correlation between channels.

As the determination result of operation S550, when the continuity of the periodicity of the input audio signal is not continuously maintained for more than the predetermined period, the mode determination unit 430 determines whether a music continuity in which frequency spectral tilt is gentle and a high frame energy is continuously maintained for a certain period is more than a predetermined level (operation S560).

As a determination result of operation S560, when the music continuity in which the frequency spectral tilt is gentle and the high frame energy is continuously maintained for the certain period is more than the predetermined level, the mode determination unit 430 determines the encoding mode to be the frequency-based encoding mode (operation S570).

As the determination result of operation S560, when the music continuity in which the frequency spectral tilt is gentle and the high frame energy is continuously maintained for the certain period is not more than the predetermined level, the mode determination unit 430 determines the encoding mode to be the time-based encoding mode (operation S580).

Figure 6:
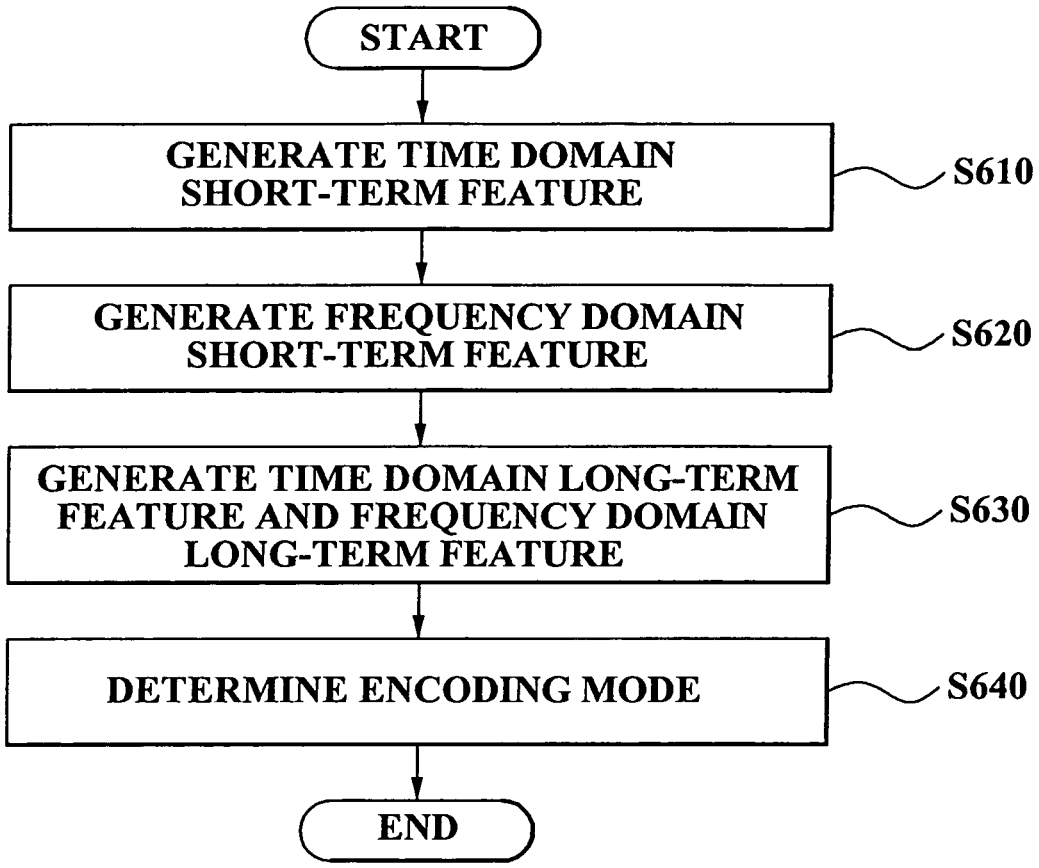
FIG. 6 is a flowchart illustrating operations of an adaptive time and/or frequency-based encoding mode determination method according to an embodiment of the present general inventive concept.

FIG. 6 is a flowchart illustrating operations of an adaptive time/frequency-based encoding mode determination method according to an embodiment of the present general inventive concept.

Referring to FIG. 6, a time domain short-term feature is generated by analyzing a time domain signal of an input audio signal (operation S610).

In this case, the time domain short-term feature may include a transition extent and a size of the short-term/long-term prediction gain of the input audio signal.

Also, a frequency domain short-term feature corresponding to each frequency band is generated by analyzing a frequency domain signal of the input audio signal (operation S620). In this case, the frequency domain short-term feature may include a voicing probability.

In this case, the frequency domain signal of a current frame of the input audio signal is analyzed in operation S620, the time domain signal corresponding to the frequency domain signal of a current or a next frame of the input audio signal may be analyzed. In this case, in operation S620, a part of a previous frame may be windowed together with the current frame.

A time domain long-term feature and a frequency domain long-term feature are generated by analyzing the time domain short-term feature and the frequency domain short-term feature (operation S630).

In this case, the time long-term feature may include continuity of periodicity, frequency spectral tilt, and/or frame energy. In this case, the continuity of the periodicity may be that a frame in which a change of a pitch lag is small and pitch correlation is high is continuously maintained longer than a certain period. Also, the continuity of the periodicity may be that a frame in which a first formant frequency is very low and pitch correlation is high is continuously maintained longer than a certain period. In this case, the frequency domain long-term feature may include correlation between channels.

An encoding mode with respect to the each frequency band is determined to be either a time-based encoding mode or a frequency-based encoding mode, by using a time domain feature and a frequency domain feature (operation S640).

Figure 7:
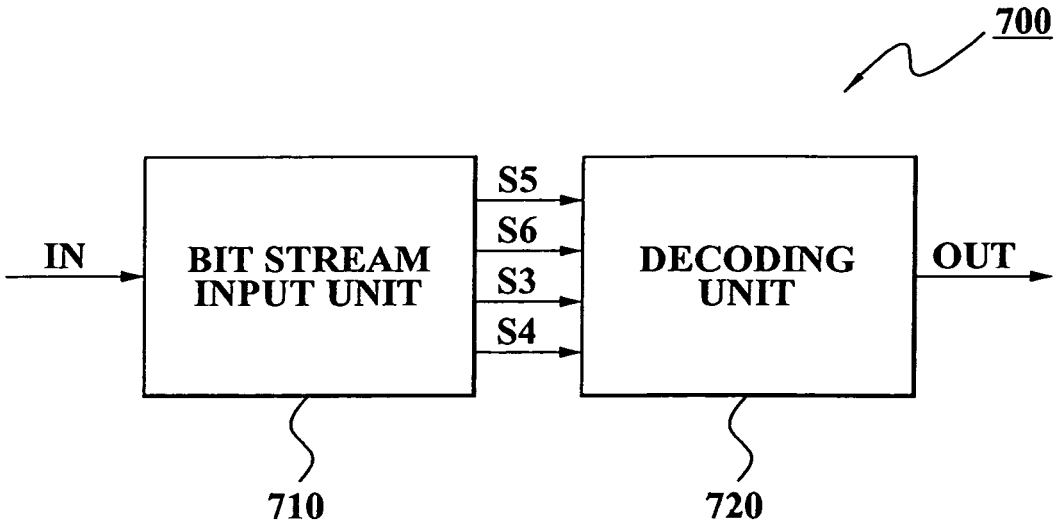
FIG. 7 is a view illustrating an adaptive time and/or frequency audio decoding apparatus according to an embodiment of the present general inventive concept.

Through the described processes, either the time-based encoding mode or the frequency-based encoding mode is selectively applied to effectively encode audio signals having various audio contents. The encoding mode is selected by an open loop style encoder, thus having a lower complexity than a closed loop style. Referring to FIG. 7, an adaptive time and/or frequency audio decoding apparatus 700 effectively decodes an encoded bit stream received by a bit stream input unit 710. The bit stream input unit 710 generates time-based encoded data S5, frequency-based encoded data S6, frequency domain division information S3, and encoding mode information S4 which are output to decoding unit 720. Decoding unit 720 decodes the time and/or frequency based encoded data using the frequency domain division information and the encoding mode information for each frequency band and outputs a decoded audio signal.

The adaptive time/frequency-based encoding mode determination method according to the present general inventive concept may be embodied as a program instruction capable of being executed via various computer units and may be recorded in a computer readable recording medium. The computer readable medium may include a program instruction, a data file, and a data structure, separately or cooperatively. The program instructions and the media may be those specially designed and constructed for the purposes of the present general inventive concept, or they may be computer readable media such as magnetic media (e.g., hard disks, floppy disks, and magnetic tapes), optical media (e.g., CD-ROMs or DVD), magneto-optical media (e.g., optical disks), and/or hardware devices (e.g., ROMs, RAMs, or flash memories, etc.) that are specially configured to store and perform program instructions.

An aspect of the present general inventive concept provides a method and apparatus, in which an encoding mode with respect to an input audio signal is determined for each frequency band to time-based encode or frequency-based encode the input audio signal, thereby acquiring high-compression performance by efficiently using a coding gain of the time-based encoding mode and the frequency-based encoding mode.

An aspect of the present general inventive concept also provides a method and apparatus, in which a long-term feature and a short-term feature are extracted for each time domain and frequency domain to determine a suitable encoding mode of each frequency band, thereby optimizing adaptive time/frequency-based audio encoding performance.

An aspect of the present general inventive concept also provides a method and apparatus in which an open loop determination style having low complexity is used to effectively determine an encoding mode.

An aspect of the present general inventive concept also provides a method and apparatus in which a feature of a next frame is reflected when a mode of a current frame is determined, thereby preventing frequent mode switching so that each frame changes the mode smoothly.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An adaptive time and/or frequency-based encoding mode determination apparatus comprising:

a time domain feature extraction device to generate a time domain feature including a time domain short-term feature and a time domain long-term feature, by analyzing a time domain of an input audio signal;

a frequency domain feature extraction device to generate a frequency domain feature including a frequency domain short-term feature and frequency domain long-term feature, by analyzing a frequency domain signal of the input audio signal; and a mode determination device to determine one of a time-based encoding mode and a frequency-based encoding mode as an encoding mode, with respect to the input audio signal in a predetermined unit, according to the time domain feature and the frequency domain feature.

2. The apparatus of claim 1, wherein, when the mode determination device determines the encoding mode with respect to a current frame, a result of analyzing the time domain with respect to a next frame is used to calculate a short-term/long-term prediction gain with respect to a previous, the current, and the next frame via a frame feature buffer.

3. The apparatus of claim 1, wherein the time domain short-term feature comprises a transition extent and a short-term/long-term prediction gain, and the frequency domain short-term feature comprises a voicing probability.

4. The apparatus of claim 3, wherein the time domain long-term feature comprises a continuity of periodicity, a frequency spectral tilt, and/or a frame energy, and the frequency domain long-term feature comprises a correlation between channels.

5. The apparatus of claim 4, wherein the mode determination device determines the encoding mode to be the frequency-based encoding mode according to at least one of:

a first condition in which a stereo extent of the input audio signal is more than a predetermined level;

a second condition in which a transition extent is less than a predetermined level;

a third condition in which the short-term/long-term prediction gain is less than a predetermined level; and a fourth condition in which a voicing probability corresponding to a frequency band is less than a predetermined level.

6. The apparatus of claim 5, wherein the mode determination device determines the encoding mode to be the time-based encoding mode when any of the first through fourth conditions are not satisfied and when any of following conditions are also not satisfied:

a fifth condition in which continuity of the periodicity of the input audio signal is continuously maintained for more than predetermined periods;

a sixth condition in which music continuity where the frequency spectral tilt is gentle and the frame energy is continuously maintained at a high level for more than a certain period, is more than a predetermined level, and the mode determination device determines the encoding mode to be the frequency-based encoding mode when any of the first through fourth conditions are not satisfied and at least one of the fifth and sixth conditions are satisfied.

7. The apparatus of claim 1, wherein the frequency domain feature extraction device transforms the input audio signal of the time domain signal by one of a modulated lapped transform, a frequency-varying modulated lapped transform, and a fast Fourier transform and analyzes the frequency domain signal to generate a frequency domain feature corresponding to each frequency band.

8. A method of determining adaptive time/frequency-based encoding mode, the method comprising:

generating, performing by using at least one processing device, time domain feature including a time domain short-term feature and a time domain long-term feature, by analyzing a time domain signal of an input audio signal;

generating a frequency domain feature including a frequency domain short-term feature and a frequency time domain long-term feature, by analyzing a frequency domain signal of the input audio signal; and determining one of a time-based encoding mode and a frequency-based encoding mode, with respect to the input audio signal in a predetermined unit, according to the time domain feature and the frequency domain feature.

9. The method of claim 8, wherein, in the determining one of a time-based encoding mode and a frequency-based encoding mode, when determining the encoding mode with respect to a current frame, a result of analyzing the time domain with respect to a next frame is used to calculate a short-term/long-term prediction gain with respect to a previous, the current, and the next frame via a frame feature buffer.

10. The method of claim 8, wherein the time domain short-term feature comprises a transition extent and a short-term/long-term prediction gain, and the frequency domain short-term feature comprises a voicing probability.

11. The method of claim 8, wherein the time domain long-term feature comprises a continuity of periodicity, a frequency spectral tilt, and/or a frame energy, and the frequency domain long-term feature comprises a correlation between channels.

12. The method of claim 8, wherein, in the determining one of a time-based encoding mode and a frequency-based encoding mode, the encoding mode is determined to be the frequency-based encoding mode when a stereo extent of the input audio signal is more than a predetermined level; a transition extent is less than a predetermined level; the short-term/long-term prediction gain is less than a predetermined level; or a voicing probability corresponding to a frequency band is less than a predetermined level.

13. The method of claim 8, wherein, in the determining one of a time-based encoding mode and a frequency-based encoding mode, the encoding mode is determined to be the time-based encoding mode when continuity of the periodicity of the input audio signal is not continuously maintained for more than predetermined periods at a same time as the frequency spectral tilt is more than a predetermined level or the frame energy at a predetermined level is not continuously maintained for more than a certain period.

14. A non-transitory computer readable recording medium in which a program to execute an adaptive time/frequency-based encoding mode determination method is recorded, the method comprising:

generating a time domain feature including a time domain short-term feature and a time domain long-term feature, by analyzing a time domain signal of an input audio signal;

generating a frequency domain feature including a frequency domain short-term feature and a frequency domain long-term feature, by analyzing a frequency domain signal of the input audio signal; and determining any one of a time-based encoding mode and a frequency-based encoding mode, with respect to the input audio signal in a predetermined unit, according to the time domain feature and the frequency domain feature.

15. An adaptive time and/or frequency-based encoding apparatus, comprising:

a mode determination device to determine a time-based encoding mode and a frequency-based encoding mode as an encoding mode according to a frequency domain feature including a frequency domain short-term feature and a frequency domain long-term feature and a time domain feature including a time domain short-term feature and a time domain long-term feature, with respect to an audio signal in a predetermined unit;

an encoder to encode the audio signal in a predetermined unit according to corresponding ones of the time-based encoding mode and the frequency-based encoding mode to generate an encode data; and a bit stream output device to process a bit stream with respect to the encoded data, and the encoding mode information of the predetermined unit, and to output the processed bit stream.

16. An adaptive time and/or frequency-based encoding apparatus, comprising:

a domain feature extraction device to extract a time domain feature and a frequency domain feature with respect to an input audio signal in a predetermined unit, respectively;

a mode determination device to determine a time-based encoding mode and a frequency-based encoding mode according to the time domain feature including a time domain long-term feature and the frequency domain feature including a frequency domain long-term feature, and to generate information on the time-based encoding mode or the frequency-based encoding mode;

an encoder to encode the input audio signal in the predetermined unit according to the time-based encoding mode or the frequency-based encoding mode; and an output device to output a bit stream including the time-based encoded data, the frequency-based encoded data, and the encoding mode information.

17. An encoding and/or decoding system, comprising:

a mode determination device to determine a time-based encoding mode and a frequency-based encoding mode as an encoding mode according to a frequency domain feature including a frequency domain long-term feature and a time domain feature including a time domain long-term feature, with respect to an audio signal in a predetermined unit; and an encoder to encode the audio signal in the predetermined unit according to corresponding ones of the time-based encoding mode and the frequency-based encoding mode and to generate a bit stream with respect to the encoded audio signal in the predetermined unit, and encoding mode information of the audio signal in the predetermined unit; and a decoder to receive the bit stream and to decode the audio signal in the predetermined unit according to corresponding ones of a time decoding mode corresponding to the time encoding mode and a frequency decoding mode corresponding to the frequency encoding mode.

18. An adaptive time and/or frequency-based decoding apparatus, comprising:

a bit stream input device to receive a processed bit stream, the processed bit stream comprising:

time-based encoded data;

frequency-based encoded data;

encoding mode information corresponding to a mode determination of an audio signal in a predetermined unit; and a decoding device to decode the time-based encoded data and the frequency-based encoded data with respect to the audio signal in the predetermined unit to generate decoded data representing an output audio signal, wherein the encoded mode information has been determined according to a frequency domain feature including a frequency domain long-term feature and a time domain feature including a time domain long-term feature with respect to the audio signal in the predetermined unit.

19. A method of determining adaptive time/frequency-based encoding mode, the method comprising:

generating, performed by using at least one processing device, a long-term feature, by analyzing an input audio signal; and determining one of a time-based encoding mode and a frequency-based encoding mode, for each frame of the input audio signal, according to whether the long-term feature is a time-domain long term feature or a frequency domain long-term feature.

* * * * *